US009907386B2

(12) United States Patent
Sanchez et al.

(10) Patent No.: US 9,907,386 B2
(45) Date of Patent: Mar. 6, 2018

(54) DEVICE FOR APPLYING A COSMETIC PRODUCT

(71) Applicant: L'OREAL, Paris (FR)

(72) Inventors: Marcel Sanchez, Aulnay Sous Bois (FR); Wendy Annonay, Paris (FR); Eric Caulier, Maignelay (FR); Audrey Thenin, Meudon (FR)

(73) Assignee: L'OREAL, Paris (FR)

( * ) Notice: Subject to any disclaimer, the term of this patent is extended or adjusted under 35 U.S.C. 154(b) by 119 days.

(21) Appl. No.: 14/901,652

(22) PCT Filed: Jun. 25, 2014

(86) PCT No.: PCT/IB2014/062588
§ 371 (c)(1),
(2) Date: Dec. 28, 2015

(87) PCT Pub. No.: WO2014/207673
PCT Pub. Date: Dec. 31, 2014

(65) Prior Publication Data

US 2016/0143419 A1 May 26, 2016

(30) Foreign Application Priority Data

Jun. 26, 2013 (FR) ..... 13 56128

(51) Int. Cl.
*A45D 40/26* (2006.01)
*A46B 1/00* (2006.01)
(Continued)

(52) U.S. Cl.
CPC ..... *A45D 40/265* (2013.01); *A46B 1/00* (2013.01); *A46B 3/005* (2013.01); *A46B 9/021* (2013.01);
(Continued)

(58) Field of Classification Search
CPC ..... A45D 40/265; A45D 40/262; A46B 1/00; A46B 3/005; A46B 9/021; A46B 9/028; A46B 2200/1053
See application file for complete search history.

(56) References Cited

U.S. PATENT DOCUMENTS 4,635,659 A 1/1987 Spatz
4,694,429 A * 9/1987 Tanaka ..... G11C 7/12 365/185.01
(Continued)

FOREIGN PATENT DOCUMENTS

CN 101199376 A 6/2008
CN 101668450 A 3/2010
(Continued)

OTHER PUBLICATIONS

Nov. 5, 2014 Search Report issued in International Patent Application No. PCT/IB2014/062588.
(Continued)

*Primary Examiner* — Rachel Steitz
(74) *Attorney, Agent, or Firm* — Oliff PLC

(57) ABSTRACT

An applicator for applying a cosmetic make-up or cosmetic care product to the eyelashes and/or the eyebrows, said applicator comprising a rod and an application member at one end of the rod, the application member being produced by molding a material and comprising a non-twisted core extending along a longitudinal axis and application elements carried by the core and arranged in a plurality of helical rows about the longitudinal axis of the core, the application member having at least one helical strip extending over more than half a revolution about the longitudinal axis of the core, which strip is free of application elements and delimited by two consecutive helical rows of application elements extending parallel to each other, the gap between said two consecutive helical rows of application elements being
(Continued)

Figure 1:
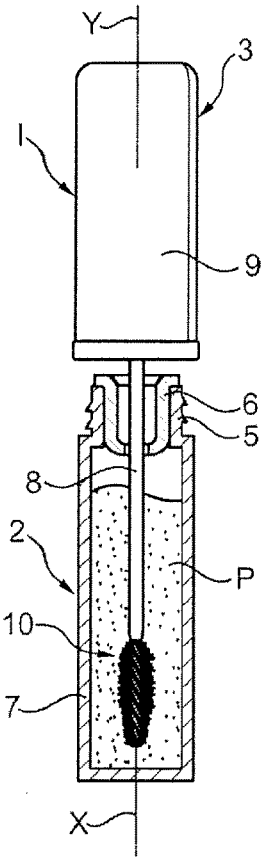

greater than the average gap between the application elements within said helical rows.

23 Claims, 4 Drawing Sheets

(51) Int. Cl.
*A46B 3/00* (2006.01)
*A46B 9/02* (2006.01)

(52) U.S. Cl.
CPC ..... *A46B 9/028* (2013.01); *A46B 2200/1053* (2013.01)

(56) References Cited

U.S. PATENT DOCUMENTS

| | | | | |
|---|---|---|---|---|
| 4,964,429 | A † | 10/1990 | Cole | |
| 8,091,566 | B2 † | 1/2012 | Salciarini | |
| 8,997,759 | B2 | 4/2015 | Wolfsgruber | |
| 2008/0245382 | A1 | 10/2008 | Marciniak-Davoult et al. | |
| 2008/0271746 | A1 | 11/2008 | Gueret | |
| 2009/0014022 | A1 * | 1/2009 | Salciarini | A45D 40/265 132/200 |
| 2010/0294299 | A1 | 11/2010 | Gueret | |
| 2011/0284021 | A1 * | 11/2011 | Gueret | A45D 40/24 132/218 |
| 2013/0315647 | A1 | 11/2013 | Gueret | |
| 2015/0250293 | A1 * | 9/2015 | Hauger | A45D 40/26 401/129 |

FOREIGN PATENT DOCUMENTS

| | | | |
|---|---|---|---|
| CN | 101686748 | A | 3/2010 |
| CN | 101801236 | A | 8/2010 |
| EP | 0474934 | A1 | 3/1992 |
| EP | 2 229 838 | A1 | 9/2010 |
| WO | 2006/039575 | A1 | 4/2006 |
| WO | 2008/113939 | A2 | 9/2008 |
| WO | 2010/067314 | A1 | 6/2010 |
| WO | 2013/076427 | A1 | 5/2013 |

OTHER PUBLICATIONS

Jun. 20, 2016 Office Action issued in Chinese Patent Application No. 201480037149.5.
Sep. 26, 2016 European Communication issued in European Patent Application No. 14744180.2.

* cited by examiner
† cited by third party

DEVICE FOR APPLYING A COSMETIC PRODUCT

The present invention relates to an applicator for applying a cosmetic product to the eyelashes and/or eyebrows, and also to a packaging and application device having such an applicator and a container containing the product to be applied.

Applicators that are produced by molding material and carry application elements disposed regularly all around a core are known in particular from the documents U.S. Pat. No. 4,635,659, EP 0 474 934, WO2006/039575 and EP 2 486 822. In these applicators, with the application elements being close together, the loading of product during application is not always optimal.

The applications FR 2 962 015 and FR 2 943 226 furthermore describe applicators having a twisted core. These applicators can be difficult to produce directly by molding and may require a post-molding operation of twisting the core.

There is a need to further improve applicators for applying a product, in particular mascara, to the eyelashes and/or eyebrows, in order to improve the performance thereof, and more particularly to promote the creation on the applicator member of zones that are more heavily laden with product, which allow rapid and abundant loading of the eyelashes and/or eyebrows, while retaining a high capacity to separate the eyelashes and/or eyebrows.

The invention aims to meet this need by virtue of an applicator for applying a cosmetic, makeup or care, product to the eyelashes and/or eyebrows, having:

- a stem, and
- an applicator member at one end of the stem, the applicator member being produced by molding material and having:
  - a non-twisted core that extends along a longitudinal axis, and
  - application elements that are carried by the core and are disposed in
  - a plurality of helical rows about the longitudinal axis of the core, the applicator member having at least one helical strip that extends through more than half a revolution about the longitudinal axis of the core, does not have application elements and is delimited by two consecutive helical rows of application elements that extend parallel to one another, the spacing between these two consecutive helical rows of application elements being greater than the mean spacing between the application elements within these helical rows.

A "non-twisted core" should be understood as meaning that the core has a circular section or a section that does not rotate on itself along its longitudinal axis.

A "helical row or strip" should be understood as meaning a row or strip that follows the path of a helix around the longitudinal axis of the core.

Each helical row of application elements and each helical strip that does not have application elements advantageously extends through more than one revolution about the longitudinal axis of the core.

The mean spacing between the application elements in a helical row is measured between the adjacent flanks of all the pairs of consecutive application elements in this row, at the point at which they are attached to the core.

The spacing between two parallel consecutive helical rows, along a given portion of length of the core, is measured in a direction perpendicular to the helices of these rows, and corresponds to the separation measured, at the core, between the lines extending along the flanks of the application elements in the two rows delimiting the strip that does not have application elements.

The invention makes it possible to obtain, on the applicator member, between two adjacent parallel helical rows of application elements, a zone that forms a reservoir that does not have application elements and acquires a surplus of product on the core after wiping. This reserve of product allows the eyelashes and/or eyebrows to be loaded immediately with a large amount of product from the first application.

By virtue of the invention, the distribution of the zone or zones that form a reservoir of product is relatively uniform along the length of the core, and a makeup result that is good in terms of loading is obtained.

Finally, the helical disposition of the application elements can favor the insertion of the eyelashes therebetween.

The helical strip or strips that do not have application elements preferably have the same helical pitch as the adjacent rows of application elements and the helix along which they extend makes the same angle with the longitudinal axis of the core as said adjacent rows.

The application elements can be disposed on the core not only so as to create helical rows but also longitudinal rows, that is to say that the application elements can also be disposed in lines parallel to the longitudinal axis of the core.

Preferably, the helices along which the application elements of the helical rows are implanted are offset from one another by an integer multiple of the spacing, along the longitudinal axis of the core, between the application elements in two adjacent longitudinal rows.

The median helix of the helical strip or strips can also be offset, with respect to the implantation helix of a helical row of application elements, by an integer multiple of this spacing.

Applicator Member

The applicator member is advantageously produced by molding a thermoplastic material, in particular an elastomer, for example SEBS, a silicone, latex, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, PET, POM, PA or PMMA. It is possible in particular to use the materials known under the trade names Hytrel®, Cariflex®, Alixine®, Santoprene®, or Pebax®, this list not being limiting.

The applicator member may be constituted by a part attached to the stem of the applicator. As a variant, the applicator member may be produced by being molded in one piece with the stem of the applicator.

The visible length of the applicator member may be between 20 mm and 30 mm, better still between 23 mm and 27 mm, being for example equal to 25 mm.

The core preferably has a circular cross section. In variants, the core has a cross section of any other shape, for example triangular, rectangular or ovoid. In this case, the core can have longitudinal faces separated by ridges parallel to the longitudinal axis of the core.

The core is preferably monolithic.

The core preferably has a rectilinear longitudinal axis, but the latter may also be curvilinear.

The thickness of the core, in particular midway along the portion carrying the application elements, may be between 2 mm and 5 mm, better still between 2.5 mm and 3 mm. The thickness of the core corresponds to its diameter when the core has a circular cross section. When the core has a polygonal section, the thickness corresponds to the diameter of the circle circumscribing the core.

At its end away from the applicator member, the stem is connected to a gripping member.

Application Elements and Helical Strips

The applicator member may have a single helical strip that does not have application elements.

In one variant, a plurality of helical strips that do not have application elements are provided between the helical rows of application elements.

The applicator according to the invention may have an alternation of helical rows of application elements and helical strips that do not have application elements, along the longitudinal axis of the core.

The helical rows of application elements and the helical strips that do not have application elements each follow the path of a helix which may have a left-hand or right-hand thread, in particular a left-hand thread. In the latter case, the helical strips and rows form turns which, when viewed along the axis of the core from its end fixed in the stem, turn in the counterclockwise direction on moving from the stem to the free end of the core.

The helix angle with respect to the longitudinal axis of the core may be between 30° and 60°. The angle is preferably constant for the entire helix. The diameter of the helix, measured at the surface of the core, may be constant.

The number of helical strips that do not have application elements may be between 4 and 10.

Each helical row may have between 25 and 40 application elements.

The applicator member may have between 100 and 400 application elements in total. In particular, there may be no other application elements than those disposed in said helical rows.

The application elements may be constituted by spikes, for example with a conical shape, preferably with a circular section at their base.

The spacing between two consecutive helical rows of application elements delimiting a helical strip that does not have application elements may be between 1.1 and 1.8 times the spacing between the application elements within these rows, better still between 1.3 and 1.6 times, and is in particular equal to 1.4 times this spacing.

The spacing between two consecutive helical rows of application elements may be between 0.5 mm and 1.5 mm.

The spacing between two consecutive helical rows of application elements delimiting a helical strip that does not have application elements is advantageously constant at all points on the core. The diameter of the helix, measured at the surface of the core, followed by a helical strip or row is thus constant. In one variant, this spacing varies.

The spacing between two consecutive helical rows may be greater than the greatest transverse dimension of the application elements in these rows.

The spacing between two consecutive application elements in a helical row is advantageously constant, being in particular the same for all the helical rows of application elements. In one variant, this spacing varies within one and the same row and/or from one row to another. For example, the spacing may become less at the ends of the row, or the application elements may be smaller.

The spacing between at least two consecutive application elements in a helical row, better still between any two consecutive elements in this row, may be less than the greatest transverse dimension of the application elements. The spacing between two consecutive application elements in a helical row is compared with the greatest transverse dimension of the application elements between which the spacing is measured. The small spacing between the application elements within a helical row makes it possible to separate the eyelashes and/or eyebrows effectively during the application of the product and to smooth the product over the surface thereof.

The spacing between two consecutive application elements in a helical row may be between 0.3 and 0.9 times the greatest transverse dimension of the application elements, in particular their diameter at their base, better still between 0.5 and 0.8 times, being for example equal to 0.7 times said greatest transverse dimension.

The spacing between two consecutive application elements in a helical row may be between 0.2 mm and 0.8 mm.

The greatest transverse dimension of an application element, which is its diameter at its base in the case of a conical spike, may be between 0.5 mm and 1 mm.

The application elements advantageously all have the same transverse dimension at their base. In one variant, the transverse dimension of the application elements at their base varies from one element to another, for example within the same helical row of application elements and/or from one row to another.

The transverse dimension of the application elements preferably decreases from their base towards their free end.

The transverse dimension of the application elements midway up their height, in particular their diameter, may be between 0.3 mm and 1 mm.

The radius of curvature of the application elements at their free end may be between 0.4 mm and 0.7 mm.

The height of the application elements may be between 0.5 mm and 5 mm, better still between 1.5 and 3 mm.

The height of the application elements may vary depending on their location on the core. The applicator member may in particular have application elements having a shorter height close to its proximal and distal ends. The diameter of the circle passing through the free ends of the application elements of smallest height may be between 4 mm and 5 mm.

The diameter of the circle passing through the free ends of the application elements of greatest height may be between 5 mm and 15 mm.

The implantation of the application elements may be such that the angle $\alpha$ about the longitudinal axis of the core between two consecutive crowns of application elements, said crowns being formed by the application elements in the helical rows, is between 10° and 20°.

The distance between two consecutive application elements in one and the same longitudinal row, measured between their free ends, may be between 2 mm and 3.5 mm. The distance between two consecutive application elements in one and the same longitudinal row, measured between the adjacent flanks of the latter in the region of the core, may be between 2 mm and 3 mm.

A "longitudinal row" should be understood as meaning a row formed by application elements, the axes of which are located in one and the same longitudinal section plane.

Within one longitudinal row, that is to say in a single longitudinal section plane, the height of the application elements can increase and then decrease towards the free end of the core.

In projection in a longitudinal section plane, three application elements belonging to different longitudinal rows can be present between two consecutive application elements in one and the same longitudinal row.

The helical rows of application elements are advantageously all identical, and are mirror images of one another by rotation about the longitudinal axis of the core through 360°/n, where n is the number of rows.

In the case in which the applicator member has at least two helical strips that do not have application elements, the latter are advantageously all identical, and are mirror images of one another by rotation about the longitudinal axis of the core through 360°/m, where m is the number of strips.

Cavities

The core may have at least one cavity, better still a plurality of cavities, each having a transverse axis with respect to the longitudinal axis of the core. The quantity of product that remains on the applicator member after wiping is thus increased.

The cavity or cavities are preferably disposed along the helical strip or strips that do not have application elements, in particular midway across the width of said helical strips that do not have application elements. The cavities are advantageously disposed in at least one helical row of cavities within the helical strip that does not have application elements.

The cavity or cavities advantageously have a semicircular section, when viewed in a section plane perpendicular to the core, and in particular are constituted by hemispherical dimples.

The cavity or cavities advantageously each open into the core by an opening, the greatest dimension of which, which is the diameter of the opening in the case in which the latter has a circular shape, is equal to the greatest transverse dimension of the application elements. In one variant, the greatest dimension of the opening is different than the greatest transverse dimension of the application elements, being greater than or less than the latter.

The cavities can all have the same opening dimension. In one variant, the opening dimension of the cavities varies from one cavity to another, in particular within one helical row of cavities and/or from one row of cavities to another.

The spacing between two cavities within one helical row of cavities, measured between the adjacent edges of the openings that open into the core, may be constant and may be the same for each row of cavities. In one variant, this spacing is variable within one and the same helical row of cavities and/or from one row to another.

In one variant, the core has at least one cavity in the form of a continuous helical groove that is disposed along the helical strip that does not have application elements and between two helical rows of application elements. In this case, the width of the groove is preferably equal to the greatest transverse dimension of the application elements in the helical rows surrounding it.

The choice of the shape of the cavity or cavities, of their greatest transverse dimension and of their distribution about the core makes it possible to set the reserve of product in the cavities after wiping.

Packaging and Application Device

A further subject of the invention is a device for packaging and applying a cosmetic, makeup or care, product to the eyelashes and/or eyebrows, having an applicator according to the invention and a container containing the product to be applied.

The gripping member of the applicator preferably constitutes a cap for closing the container in a sealed manner.

The container preferably has a member for wiping the applicator.

Figure 2:
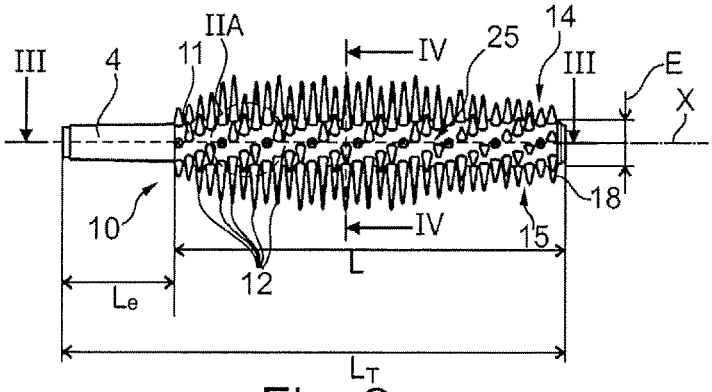
Figure 2A:
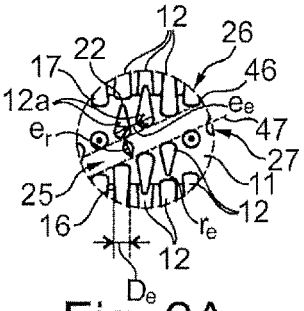
Figure 3:
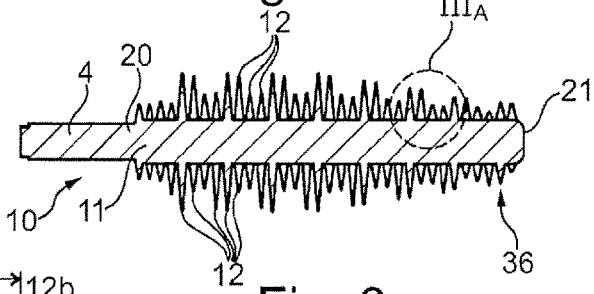
Figure 3A:
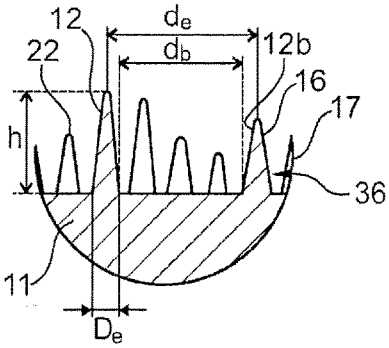
Figure 4:
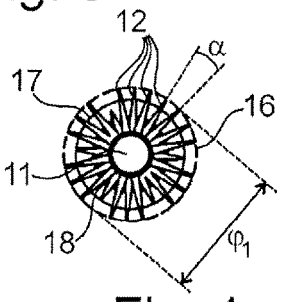
Figure 5:
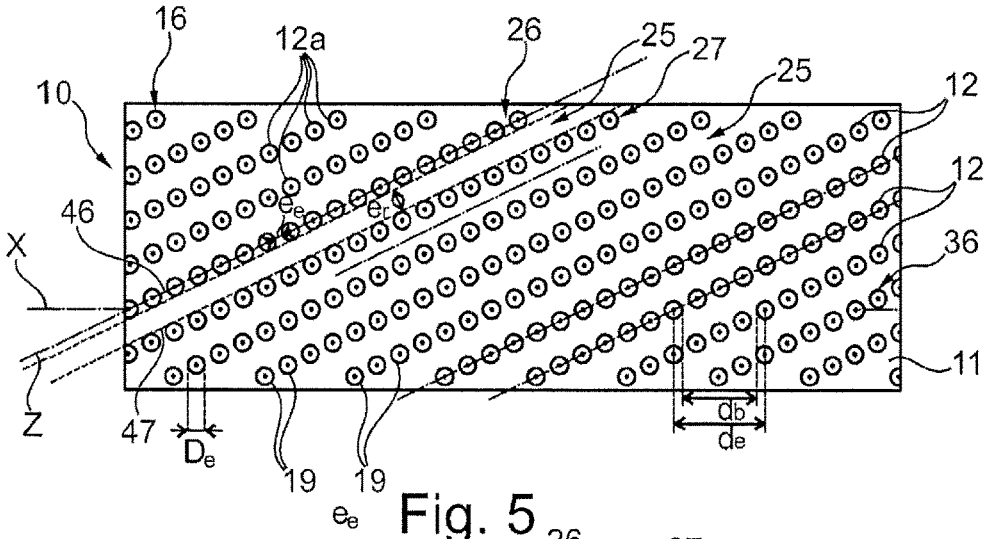
Figure 6:
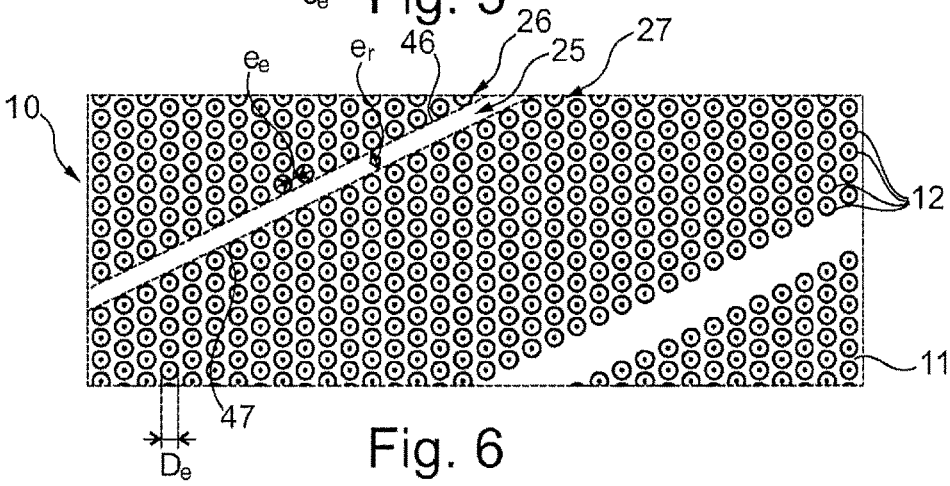
Figure 7:
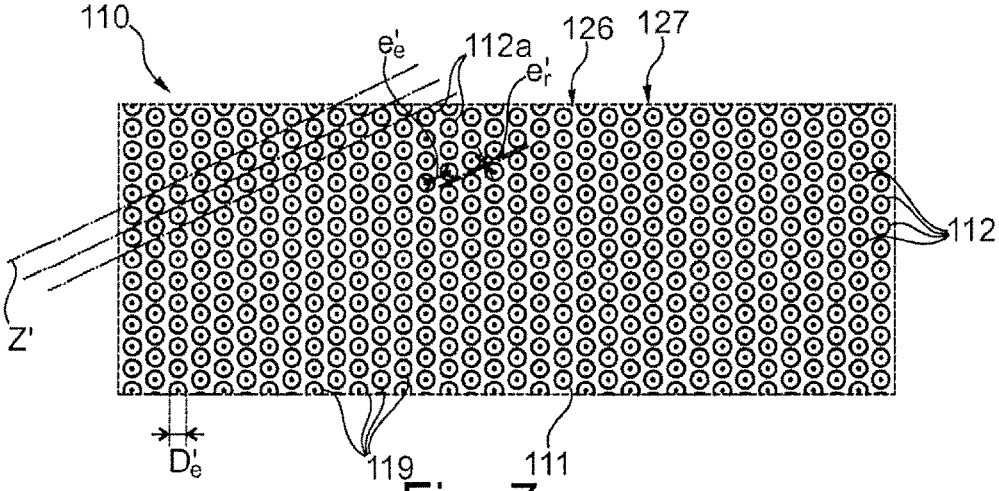
Fig. 7 PRIOR ART
Figure 8:
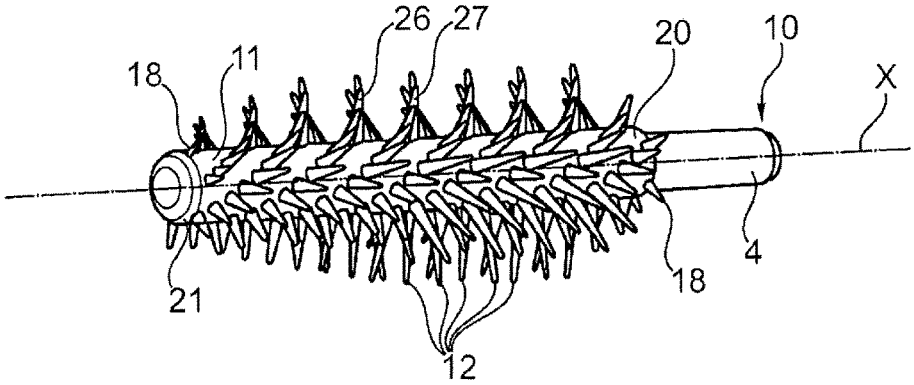
Figure 9:
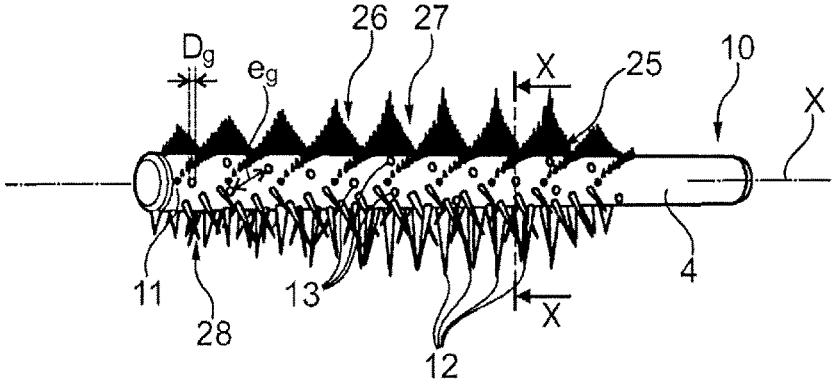
Figure 10:
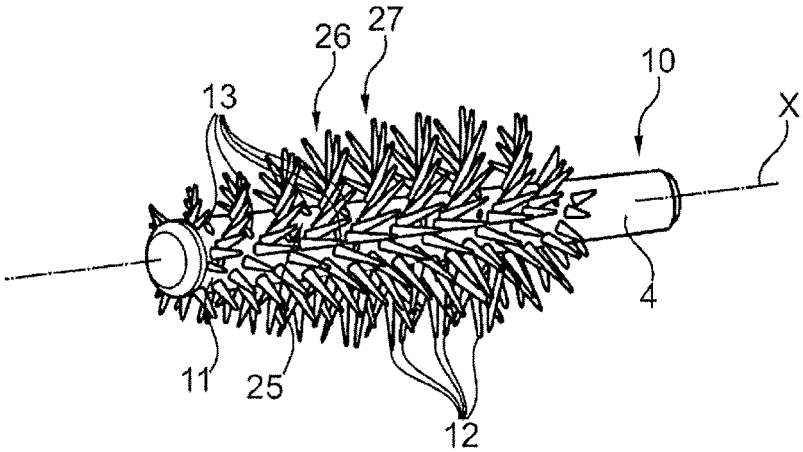
Figure 11:
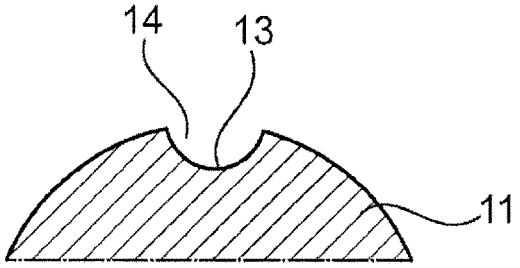
Figure 12:
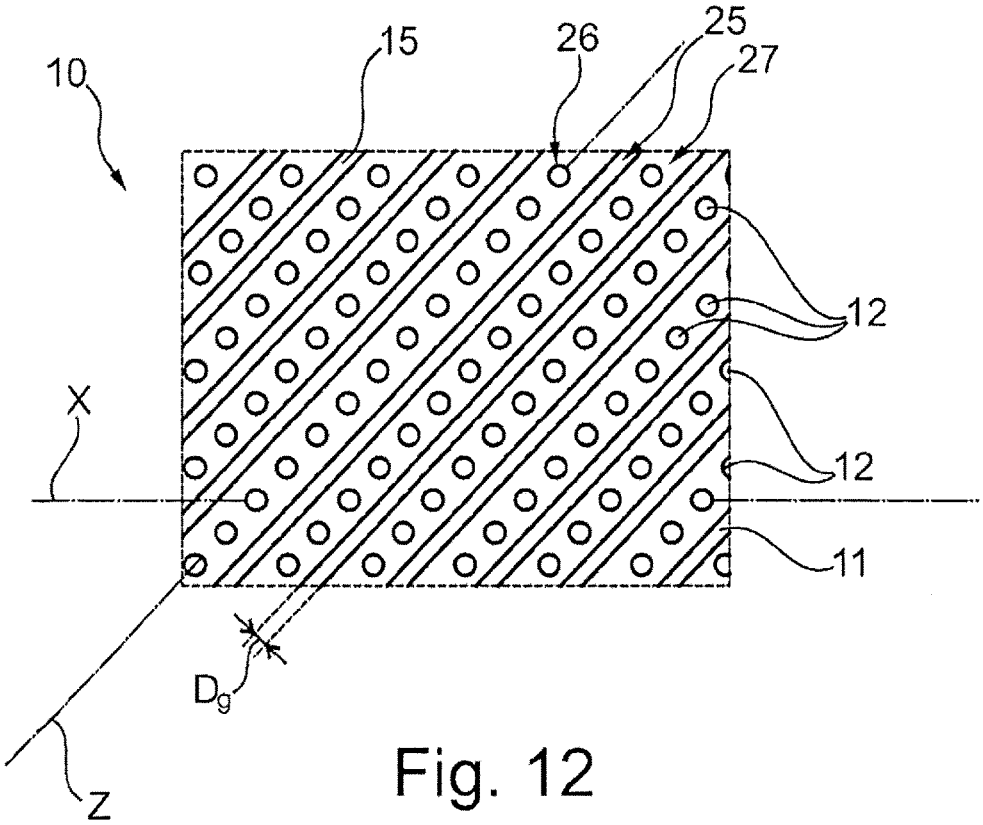

The invention may be better understood from reading the following detailed description of nonlimiting implementation examples thereof, and with reference to the appended drawing, in which:

FIG. 1 schematically shows, in longitudinal section, an example of a packaging and application device produced in accordance with the invention, FIG. 2 shows the applicator member from FIG. 1 on its own, FIG. 2A is a detail of the applicator member from FIG. 2, FIG. 3 is a section along III-III of the applicator member from FIG. 2, FIG. 3A is a detail of the applicator member from FIG. 3, FIG. 4 is a cross section along of the applicator from FIG. 2, FIG. 5 is a flat developed view illustrating the arrangement of some of the application elements on the surface of the core of an applicator according to the invention, FIG. 6 is a view, similar to FIG. 5, of a variant embodiment of an applicator according to the invention, FIG. 7 is a developed view illustrating the arrangement of some of the application elements on the surface of the core of an applicator according to the prior art, FIG. 8 shows a perspective view of the applicator member from FIG. 2, FIGS. 9 and 10 are views, similar to FIG. 8, of a variant embodiment of an applicator according to the invention, FIG. 11 is a cross section along X-X of the core of the applicator from FIG. 9, and FIG. 12 is a developed view of a variant embodiment of an applicator according to the invention.

The packaging and application device 1 shown in FIG. 1 has a container 2 containing a product P to be applied to the eyelashes and/or eyebrows and an applicator 3 which may be fixed removably to the container 2.

The applicator 3 has a stem 8 of longitudinal axis Y, which is provided at one end with an applicator member 10, which will be described in detail below, and at the other end with a gripping member 9 that likewise forms a cap for closing the container 2 in a sealed manner. The latter has a body 7 which is provided at the top with a threaded neck 5 onto which the gripping member 9 can be screwed in order to close the container 2 in a sealed manner. In a variant, the applicator 3 can be fixed to the container 2 in some other way.

The neck 5 may accommodate, as illustrated, a wiping member 6 which is for example inserted into the neck 5. This wiping member 6 has for example a lip that defines a wiping orifice having a diameter adapted to that of the stem 8. The wiping member 6 may be of any type, attached to the container 2 or molded together therewith. The wiping member 6 may also be adjustable. In a variant, the neck 5 of the container 2 may be attached.

In the example illustrated, the stem 8 has a rectilinear longitudinal axis Y, but if the stem 8 is not rectilinear, this does not depart from the scope of the present invention. The stem 8 may have a flexible part at its distal end, optionally provided with an annular groove, the applicator member 10 then being attached to this flexible part.

The product P is intended to be applied to the eyelashes and/or eyebrows. It may comprise iron oxide, among other pigments, and an aqueous or organic solvent, depending on the formulation.

All or part of the applicator member 10 has been schematically illustrated on its own in FIGS. 2 to 6 and 8.

The applicator member 10 is produced by molding thermoplastic material in the example described.

The applicator member 10 has a core 11 that extends along a longitudinal axis X, which is rectilinear in the example described, but which could also be curvilinear. The core has a circular cross section, but could have a cross section of any other shape, for example triangular, rectangular or ovoid.

The core 11 is not twisted.

The thickness E of the core 11 is between 2 mm and 5 mm, and is for example equal to 3 mm in the example in question.

The applicator member 10 has an end piece 4 molded in one piece with the core 11, this end piece 4 serving to fix the applicator member 10 in the stem 8. The length $L_e$ of the end piece 4 may be between 5 mm and 8 mm, and is for example equal to around 7 mm.

The visible length L of the applicator member 10, which corresponds to the length of the core 11 carrying the application elements 12, is between 20 mm and 30 mm, better still between 23 mm and 27 mm, and is for example equal to 25 mm in the example in question.

The total length $L_T$ of the applicator member 10, corresponding to the core 11 and to the end piece 4, is between 23 mm and 40 mm, and is for example equal to around 32 mm in the example in FIGS. 1 to 4.

The core 11 carries application elements 12 disposed in a plurality of helical rows about the longitudinal axis X of the core 11, the implantation helices extending parallel to one another, with a constant spacing between one another.

The applicator member 10 also has, in the example in FIGS. 1 to 5 and 8, a plurality of helical strips 25 that do not have application elements and are each delimited by two consecutive helical rows of application elements 12.

In the example in question, the applicator member 10 has an alternation of helical rows of application elements 12 and helical strips 25 that do not have application elements, along the longitudinal axis X of the core 11.

Each helical row of application elements 12 and each helical strip 25 that does not have application elements advantageously extends through more than one revolution about the longitudinal axis X of the core 11.

In the example described, the helical rows of application elements 12 and the helical strips 25 that do not have application elements each follow the path of a helix with a left-hand thread. In one variant, the helix could have a right-hand thread.

The helix angle with respect to the longitudinal axis X of the core 11 is preferably, as illustrated, between 30° and 60°, and is for example equal to 45°. The helix angle is the angle made by the implantation helix with the longitudinal axis of the core when the applicator member is viewed from the side, as in FIG. 2.

The developed surface of the core 11 of an applicator member 10 of an applicator according to the invention is shown in FIG. 5, and the bases 19 of the application elements 12 by which the latter are attached to the core 11 are depicted in this figure. The helical rows 26, 27 of application elements 12 and the helical strips 25 that do not have application elements each extend along a line Z, the angle of which with the longitudinal axis X of the core 11 corresponds to the helix angle.

As shown in FIGS. 2A and 5, the spacing $e_r$ between two consecutive helical rows 26, 27 of application elements, which is measured in a direction perpendicular to the orientation of the rows and corresponds to the separation measured, at the core 11, between the lines extending along the flanks 12*a* of the application elements 12 in the two rows 26, 27 delimiting a strip 25 that does not have application elements, is greater than the mean spacing $e_e$ between the application elements 12 within these helical rows, this spacing $e_e$ being in this case the same for all the application elements in the row.

The spacing $e_r$ between two consecutive helical rows 26, 27 of application elements is moreover greater than the greatest transverse dimension $D_e$ of the application elements 12.

The spacing $e_r$ is preferably between 1.1 and 1.8 times the spacing $e_e$ between two application elements 12 in a helical row, better still between 1.3 and 1.6 times, and is equal to 1.4 times the spacing $e_e$ between two application elements 12 in a helical row in the example described. The spacing $e_r$ is preferably between 0.5 mm and 1.5 mm, and is for example equal to 0.7 mm.

The spacing between two consecutive application elements 12 in a helical row 26, measured between the adjacent flanks 12*a* of the latter at the core 11, is moreover less than the greatest transverse dimension $D_e$ of the application elements 12, specifically in this case the diameter at their base 19, along the entire length L of the core 11.

The spacing is preferably between 0.3 and 0.9 times the greatest transverse dimension $D_e$ of the application elements, better still between 0.5 and 0.8 times, and is equal to 0.7 times said greatest transverse dimension $D_e$ in the example in question. The spacing is preferably between 0.2 mm and 0.8 mm, and is for example equal to 0.4 mm.

When an applicator 3 according to the invention is used, after the applicator member 10 has passed through the wiping member 6, the relatively large spacing between the helical rows, which is due to the presence of the helical strips 25 that do not have application elements, makes it possible to obtain zones that form a reservoir of product P between the rows, in the region of said strips 25, and thus satisfactory loading of the eyelashes and/or eyebrows during application.

As in the example described, the spacing $e_e$ between two consecutive application elements 12 in a helical row 26 is preferably constant, being the same for each helical row of application elements, all of the application elements 12 having for example the same diameter at their base 19. The spacing $e_r$ between two helical rows delimiting a helical strip is likewise constant at all points on the core 11.

In a variant that is not shown, the spacings $e_e$ and $e_r$ are variable. The spacing $e_e$ between two consecutive application elements 12 can vary within one and the same row and/or can vary from one row to another. The spacing $e_r$ can vary between some helical rows.

The number of helical strips 25 that do not have application elements is preferably between 1 and 10, and is equal to 6 in the example described.

In the example described, the helical rows of application elements 12 are all identical, and are mirror images of one another by rotation about the longitudinal axis X of the core 11 through 360°/n, where n is the number of rows, i.e. for example 60°.

Each helical row of application elements 12 has between 25 and 40 application elements, for example around 35.

The applicator member 10 preferably has between 100 and 400 application elements 12, for example around 200. It is possible for the applicator member 10 not to have any other application elements 12 than those disposed in the helical rows, as illustrated.

In the example which has just been described, a plurality of helical strips 25 that do not have application elements are provided between the helical rows of application elements 12. In the variant shown in FIG. 6, the applicator member 10 has a single helical strip 25 that does not have application elements.

The greatest transverse dimension $D_e$ of an applicator element 12, which is its diameter at its base 19 in the example in question, may be between 0.5 mm and 1 mm, and is for example equal to 0.5 mm.

The developed surface of the core 111 of an applicator member 110 of an applicator according to the prior art is shown in FIG. 7, and the bases 119 of the application elements 112 by which the latter are attached to the core 111 are depicted in this figure. The helical rows 126, 127 of application elements 112 each extend along a line Z'.

This applicator member 110 has a spacing $e_r'$ between two consecutive helical rows 126, 127 which is measured in a direction perpendicular to the orientation of the rows and corresponds to the separation measured, at the core 111, between the lines extending along the flanks 112*a* of the application elements 112 in the two rows 126, 127. This spacing $e_r'$ is less than the spacing $e_e'$ between two consecutive application elements in these rows and than the greatest transverse dimension $D_e'$ of the application elements 112. The possibility of obtaining zones that form a reservoir of product P after wiping of the applicator member 110 is thus limited.

In the example of an applicator according to the invention in FIGS. 1 to 6 and 8, the applicator elements 12 have a height h which varies depending on their position on the core 11. As shown in FIG. 3A, the application elements 12 of a crown 16, formed by the application elements 12 that occupy one and the same axial position on the longitudinal axis X, can have a height h greater than or equal to that of the application elements 12 in the consecutive crown 17, in the direction of the free end of the core, beginning at a particular rank starting from the proximal end of the core. In one variant that is not illustrated, the application elements 12 are all the same height h. In a further variant, the application elements 12 have a height h which varies in some other way along the core 11, the envelope surface of the applicator member 10 being able to have any shape, in particular a cylindrical, cylindrical conical, biconical, ovoid, fish-shaped, peanut-shaped, ball-shaped, ogival, etc. shape.

As can be seen in FIG. 4, the greatest diameter $\phi_1$ of the circle passing through the free ends of the application elements 12 of the crown 16 can be between 5 mm and 15 mm, and is for example equal to 8 mm.

The angular offset $\alpha$ about the longitudinal axis X of the core 11 between two consecutive crowns 16 and 17 can be between 10° and 20°, and is for example equal to 15°, as in the example shown in FIG. 4.

The applicator member 10 can have application elements 12 having a shorter height close to its proximal 20 and distal 21 ends.

As shown in FIG. 3, within one longitudinal row 36, that is to say in a single longitudinal section plane, the height h of the application elements 12 can increase and then decrease towards the free end of the core 13.

The height h of the application elements 12 is for example between 0.5 mm and 5 mm.

The transverse dimension of the application elements 12 can decrease from their base 19 towards their free end 22.

The radius of curvature $r_e$ of the application elements 12 at their free end 22 is preferably between 0.4 mm and 0.7 mm, and is for example equal to 0.5 mm.

As shown in FIGS. 3A and 5, the distance $d_e$ between two consecutive application elements 12 in one and the same longitudinal row 36, measured between their free ends 22, can be between 2 mm and 3.5 mm, and is for example equal to 3 mm. The distance $d_b$ between two consecutive application elements 12 in one and the same longitudinal row, measured between the adjacent flanks 12*a* of the latter in the region of the core 11, may be between 2 mm and 3 mm, and is for example equal to 2.5 mm.

As shown in FIGS. 3 and 3A, three application elements 12 belonging to different longitudinal rows can be present, in projection, between two consecutive application elements in one and the same longitudinal row 36.

The application elements 12 are constituted in the example illustrated by spikes having a conical shape with a circular section at their base. However, the invention is not limited to application elements in the form of conical spikes, and other shapes of spikes are possible, for example having a flattened cross section.

In the variant shown in FIGS. 9 to 11, the core 11 has a plurality of cavities 13, each having a transverse axis with respect to the longitudinal axis of the core 11.

The cavities 13 are disposed along the helical strips 25 that do not have application elements, and are thus disposed in a plurality of helical rows of cavities. In the example described, each row of cavities is disposed midway across the width of a helical strip 25 that does not have application elements.

As shown in FIG. 11, the cavities, constituted by hemispherical dimples, have a semicircular section in a section plane perpendicular to the axis of the core 11, but the invention is not limited to a particular shape of cavity.

In the example in question, the cavities 13 open into the core 11 by an opening 14, the greatest dimension $D_g$ of which, which is the diameter of the opening, is equal to the greatest transverse dimension $D_e$ of the application elements 12. In a variant that is not shown, the greatest dimension $D_g$ of the opening 14 is different than the greatest transverse dimension $D_e$ of the application elements 12.

In the example described, the cavities 13 all open into the core 11 by openings 14 having the same greatest dimension $D_g$. In one variant, the greatest dimension $D_g$ of the openings 14 varies within a helical row of cavities and/or from one row to another.

The spacing $e_g$ between two cavities 13 within a helical row 28 of cavities is constant in the example described, and is the same for all the rows of cavities. In one variant that is not shown, the spacing $e_g$ between two cavities 13 in a helical row of cavities is variable within one and the same row and/or from one row to another.

In one variant that is shown in FIG. 12, the core 11 has at least one cavity in the form of a continuous helical groove 15 that is disposed along a helical strip 25 that does not have application elements and between two helical rows of application elements 12. The greatest transverse dimension $D_g$ of the groove is its width at the core 11, and it is equal to the greatest transverse dimension $D_e$ of the application elements 12 in the helical rows surrounding it.

The invention is not limited to the examples that have just been described.

Combining the features of the examples illustrated into variants that are not illustrated would not constitute a departure from the scope of the present invention.

In the examples described, the application elements 12 all have the same greatest transverse dimension $D_e$. In one variant that is not shown, the greatest transverse dimension $D_e$ of the application elements 12 varies from one element to another, for example within the same helical row of application elements and/or from one row to another.

The application elements 12 may comprise a material that has bacteriostatic properties and/or promotes slip and/or is magnetic.

The applicator 3 may be subjected to vibrations during use, and/or be heated, that is to say have a heating element, and/or be able to rotate. It is also possible for the applicator member 10 to be able to vibrate and to be heated or only to be able to vibrate or only to be heated or only to be able to rotate. When the applicator is able to rotate, the gripping member 9 may house an electric motor for rotating the stem.

The expression "having a" should be understood as being synonymous with "having at least one".

The invention claimed is:

1. An applicator for applying a cosmetic, makeup or care, product to the eyelashes and/or eyebrows, having:

a stem, and an applicator member at one end of the stem, the applicator member being produced by molding material and having:

a non-twisted core that extends along a longitudinal axis, and application elements that are carried by the core and are disposed in a plurality of helical rows about the longitudinal axis of the core, the applicator member having at least one helical strip that extends through more than half a revolution about the longitudinal axis of the core, does not have application elements, and is delimited by two consecutive helical rows of application elements that extend parallel to one another, the spacing between these two consecutive helical rows of application elements being greater than the mean spacing between the application elements within these helical rows, the spacing between these two consecutive helical rows of application elements being between 1.1 and 1.8 times the mean spacing between the application elements within these helical rows, and the spacing between two consecutive application elements in a helical row being constant.

2. The applicator as claimed in claim 1, wherein the helical strip that does not have application elements extends through more than one revolution about the longitudinal axis of the core.

3. The applicator as claimed in claim 1, wherein a plurality of helical strips that do not have application elements are provided between the helical rows of application elements.

4. The applicator as claimed in claim 3, which has an alternation of helical rows of application elements and helical strips that do not have application elements, along the longitudinal axis of the core.

5. The applicator as claimed in claim 1, wherein the spacing between at least two consecutive application elements in a helical row is less than the greatest transverse dimension of the application elements.

6. The applicator as claimed in claim 1, wherein the spacing between any two consecutive application elements in a helical row, is between 0.3 and 0.9 times the greatest transverse dimension of the application elements.

7. The applicator as claimed in claim 6, wherein the spacing between any two consecutive application elements in a helical row, is between 0.5 and 0.8 times the greatest transverse dimension of the application elements.

8. The applicator as claimed in claim 1, wherein the spacing is constant at all points on the core.

9. The applicator as claimed in claim 1, wherein the helical rows of application elements and the helical strip that does not have application elements are at a helix angle of between 30° and 60° with respect to the longitudinal axis of the core.

10. The applicator as claimed in claim 1, wherein the height of the application elements varies depending on their location on the core.

11. The applicator as claimed in claim 1, wherein the core has at least one cavity, the greatest dimension of which is equal to the greatest transverse dimension of the application elements.

12. The applicator as claimed in claim 11, wherein the core has several cavities, the cavities being disposed in a plurality of helical rows, the spacing between two cavities within one helical row being constant and being the same for all the rows of cavities.

13. The applicator as claimed in claim 11, wherein the core has at least one cavity in the form of a continuous helical groove.

14. The applicator as claimed in claim 13, wherein the core has at least one cavity in the form of a continuous helical groove and extending along a helical strip that does not have application elements.

15. The applicator as claimed in claim 11, wherein the core has a plurality of cavities.

16. The applicator as claimed in claim 15, wherein the cavity or cavities are in the form of dimples.

17. The applicator as claimed in claim 16, wherein the cavity or cavities are in the form of dimples, each having an axis oriented transversely to the longitudinal axis of the core.

18. The applicator as claimed in claim 15, wherein the cavity or cavities are disposed along the helical strip or strips that do not have application elements.

19. The applicator as claimed in claim 18, wherein the cavity or cavities are disposed midway across the width of the helical strip or strips.

20. The applicator as claimed in claim 15, wherein the cavity or cavities open into the core by an opening.

21. Device for packaging and applying a cosmetic, makeup or care, product to the eyelashes and/or eyebrows, having an applicator as defined in claim 1 and a container containing the product to be applied.

22. The applicator as claimed in claim 1, wherein the spacing between any two consecutive elements in a helical row is less than the greatest transverse dimension of the application elements.

23. The applicator as claimed in claim 1, wherein the spacing between two consecutive application elements in a helical row is the same for each helical row of application elements.

* * * * *